US010781646B2

(12) United States Patent
Leiper et al.

(10) Patent No.: US 10,781,646 B2
(45) Date of Patent: Sep. 22, 2020

(54) RELOCKABLE SHEARING SWIVEL TOOL APPARATUS AND METHOD

(71) Applicant: Odfjell Well Services Norway AS, Tananger (NO)

(72) Inventors: Simon Leiper, Dubai (AE); Nikolas Tzallas, Chalkis (GR); Raymond Cain, London (GB)

(73) Assignee: ODFJELL WELL SERVICES NORWAY AS, Tananger (NO)

( * ) Notice: Subject to any disclaimer, the term of this patent is extended or adjusted under 35 U.S.C. 154(b) by 1036 days.

(21) Appl. No.: 15/266,654

(22) Filed: Sep. 15, 2016

(65) Prior Publication Data

US 2017/0081927 A1 Mar. 23, 2017

Related U.S. Application Data

(60) Provisional application No. 62/221,788, filed on Sep. 22, 2015.

(51) Int. Cl.
*E21B 17/05* (2006.01)
*E21B 17/046* (2006.01)
(Continued)

(52) U.S. Cl.
CPC ..... *E21B 17/046* (2013.01); *E21B 17/05* (2013.01); *E21B 19/16* (2013.01); *E21B 23/006* (2013.01); *E21B 23/02* (2013.01); *E21B 37/00* (2013.01)

(58) Field of Classification Search
CPC ..... E21B 17/05; E21B 19/16; E21B 23/006; E21B 23/02
See application file for complete search history.

(56) References Cited

U.S. PATENT DOCUMENTS 6,279,657 B1 * 8/2001 Carmichael ..... E21B 21/103 166/311
6,497,295 B1 * 12/2002 Carmichael ..... E21B 17/06 166/317
2012/0234559 A1 * 9/2012 Howlett ..... E21B 17/05 166/381

* cited by examiner

*Primary Examiner* — Robert E Fuller
*Assistant Examiner* — Lamia Quaim
(74) *Attorney, Agent, or Firm* — Roy Kiesel Ford Doody & North, APLC; Brett A. North

(57) ABSTRACT

A wellbore cleaning system provides a relockable shearing swivel tool that can be used in tandem with a lockable weight set circulation tool. Suspended from an upper drill string is an assembly consisting of a landing sub, the lockable weight set circulation tool and relockable shearing swivel tool are located immediately above a liner top and from which is suspended a lower drills string. The lower drill string and production liner are both significantly smaller in diameter than the upper drill string and production casing such than when fluid is pumped at high rates through the entire drill string and reduced cross sectional area of the lower drills string and production liner causes a large pressure drop characterized at surface by a high pump pressure. As part of the method, an operator makes up a drill string assembly that includes an upper drill string, a lower drill string, a landing sub or device, the lockable weight set circulation tool, and the relockable shearing swivel tool. This drill string assembly is lowered into a wellbore until the landing sub is close to a liner top or other shoulder in the wellbore. The drill string is rotated and reciprocated, pumping cleaning chemicals through the entire drill string and through the production liner. The liner top is engaged with the landing sub to open a circulation path from the upper drill string to an upper annulus. The drill string is rotated and reciprocated while pumping cleaning chemicals through the upper annulus to clean the production casing.

12 Claims, 10 Drawing Sheets

(51) Int. Cl.

| | |
|---|---|
| ***E21B 23/02*** | (2006.01) |
| ***E21B 23/00*** | (2006.01) |
| ***E21B 19/16*** | (2006.01) |
| ***E21B 37/00*** | (2006.01) |

RELOCKABLE SHEARING SWIVEL TOOL APPARATUS AND METHOD

CROSS-REFERENCE TO RELATED APPLICATIONS

This application claims benefit of U.S. Provisional Application Ser. No. 62/221,788, filed on 22 Sep. 2015, which is incorporated herein by reference and priority of/to which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an oil well down hole tool that provides a fail-safe device and method, the device operable to improve the effectiveness of cleaning a wellbore which includes at least one surface casing and at least one liner through a combination of improved rotation and reciprocation of the drill string while allowing the casing and liners to be circulated independently.

2. General Background of the Invention

It is typical to drill an oil well and run a series of casing which are cemented in place. In most cases, the casing will extend to a surface area and is called a surface casing. The innermost casing string is called the production casing. In some cases for reasons of economy there will be installed a liner. A liner is identical to casing except that it does not return all the way to the surface, but is instead suspended from the casing using a device known as a liner hanger. The final liner hanger which isolates the hydrocarbon bearing formation will typically be known as a production liner.

It is understood that where a production liner is hung from a production casing to form a wellbore, the production liner will be of substantially smaller diameter than the production casing. It is common practice to clean a wellbore before using it to produce hydrocarbons. Those familiar with the art of wellbore cleaning will understand that there are three important elements to consider when performing a wellbore cleanup. These are rotation of the drill pipe, reciprocation of the drill pipe and circulation of the cleaning fluid in the wellbore, and as a rule of thumb, the faster the better. Suffice it to say that excluding or restricting any one of these three actions, the speed and efficiency of the cleaning operation will be compromised.

Circulation is the primary method of removing unwanted debris from the wellbore. Good wellbore cleaning is a function of density, viscosity and annular velocity Annular velocity and viscosity conspire to determine the flow regime of the fluid, commonly referred to as laminar or turbulent. Chemicals such as solvents, surfactants and detergents used to clean the well work better in turbulent flow, and since it is easier to induce turbulent flow in low viscosity fluids, the preference is to prepare chemical washes with low viscosity. It is easier to carry debris from the wellbore with high viscosity fluids. A comprehensive wellbore cleanup will include pumping both high viscosity sweeping fluids and low viscosity chemical washes. These fluids are pumped as fast as possible to maximize the turbulence of the chemicals and the carrying capacity of the viscous sweeps. The fluid can be assisted further by using mechanical agitation by rotating and reciprocating the drill pipe.

Drill pipe consists of a tube connected by tool joints which include threaded couplings. The tool joints are typically larger diameter than the pipe body and when screwed together form a drill string. The outer surface consists of long slender pipe bodies with multiple large diameter protrusions or tool joints. As the drill pipe is suspended in the wellbore, it rarely sits concentric in the center of the wellbore. Due to gravity and well geometry, it will usually favour one side resulting in an eccentric shaped annulus. Cleaning fluids which are being pumped will favour the larger area of the annulus which is more open. This results in a dead volume being created under the drill pipe and between the tool joints where there is little or no flow.

The mechanical action of rotating the drill pipe serves to act as an impeller, drawing fluid from the main flow path under the drill pipe and consequently pushing debris out into the main flow path to be removed from the wellbore. The mechanical action of reciprocating the drill pipe uses the tool joints to drag debris upwards and when combined with the rotation causes an oscillating movement to assist in mechanical agitation of the fluid and to increase the turbulence of the fluid.

If during a wellbore clean-up there is no rotation or reciprocation, there may be significant areas of the wellbore which were not exposed to turbulent flow and will not have been properly cleaned by the chemicals and there may be debris trapped under the drill pipe. Further to this, when cleaning a wellbore with a production liner suspended from a production casing an operator will typically use what is called a tapered drill string, such that there is a larger diameter drill pipe in the production casing and small diameter drill pipe in the production liner. One reason this benefits wellbore cleaning is to maximize the annular flow rate and also to use the largest inner diameter pipe possible to reduce the pressure losses within the drill pipe while pumping.

Every drilling rig will have a practical limitation on the power of their pumps, where power is a function of pressure and flow rate. Therefore, drill pipe is typically selected to provide a balance between pressure loss while pumping down the pipe and flow rate when the returning fluid passes up the annulus. The following scenario is typical, where a 9⅝" casing is set with a 5½" production liner. Inside the wellbore is a tapered drill string consisting of 5" drill pipe inside the 9⅝" casing and 2⅞" drill pipe inside the 5½" casing.

The optimum flow rate for cleaning the 9⅝" casing may be 13-18 barrels per minute (BPM), whereas the optimum flow rate for cleaning the 5½" liner may be 3-5 BPM. If the operator pumps through the 5" drill pipe and 2⅞" drill pipe, he will most likely only be able to achieve a maximum of 5 BPM at the maximum pressure or power output of the pump. This is sufficient to clean the 5½" liner but not the 9⅝" casing. Therefore, it is now common practice to install a circulation device in the drill string immediately above the liner hanger. By opening this device, the operator no longer needs to pump through the 2⅞" drill pipe and can now achieve the optimum flow rates to clean the 9⅝" casing.

There is a drawback to using a tapered string, that the strength of the Upper Drill String is much higher than the strength of the Lower Drill String. For example, a 5" drill pipe string may be rated to 50,000 ft. lbs. while the 2⅞" drill pipe may be rated to 13,000 ft. lbs. When rotating the drill string to clean the well, if the drill string becomes stuck, it may result in over-torquing the 2⅞" drill pipe resulting in a 'twist off' or failure due to torsion. This can happen quickly before the rig safety systems detect it. This will result in a costly fishing operation. Operators are so fearful of this that they limit or prohibit the rotation of 2⅞" drill pipe when used with a tapered string for wellbore cleaning. Patents have been issued that relate to circulation of well fluid. Examples are listed in the following table, each listed patent of the table hereby incorporated herein by reference.

| Pat. No. | Title | Issue Date |
|---|---|---|
| 6,152,228 | Apparatus and Method for Circulating Fluid in a Borehole | Nov. 28, 2000 |
| 6,279,657 | Apparatus and Method for Circulating Fluid in a Well Bore | Aug. 28, 2001 |
| 7,703,533 | Shear Type Circulating Valve and Swivel with Open Port Reciprocating Feature | Apr. 27, 2010 |
| 8,403,067 | Repeatable, Compression Set Downhole Bypass Valve | Mar. 26, 2013 |
| 6,497,295 | Torque Limiting Tool | Dec. 24, 2002 |
| 7,011,162 | Hydraulically Activated Swivel for Running Expandable Components with Tailpipe | Mar. 14, 2006 |
| 7,798,230 | Downhole Tool | Sep. 21, 2010 |
| 2014/0299379 | Down-Hole Swivel Sub | Oct. 9, 2014 |
| GB2272923 | Apparatus for Circulating Fluid | Jun. 1, 1994 |

U.S. Pat. No. 6,279,657 discloses a circulating tool for circulating fluid in a borehole which features an obturating member to selectively open and close a circulation device, while simultaneously disengaging and engaging a splined drive mechanism. The tool is run immediately above a liner top and typically run with a tapered string for cleaning wellbores with a production casing and production liner as described previously. It works by allowing fluid to be pumped down through the string to clean the production liner, then can be opened by setting the tool on the liner top, opening the circulation ports and simultaneously disengaging a spline which allows the production casing to be cleaning at a high flow rate, and also while rotating the 5" drill pipe. The 2⅞" drill pipe does not rotate as the spline has disengaged. The limitation of this method is that it is not possible to reciprocate the drill pipe while cleaning the production casing since weight must be maintained to keep the circulation ports opened. Although the design of the tool does not prevent either reciprocation or rotation when cleaning the production liner, as disclosed previously, the operator may either limit or prohibit rotation for fear of a 'twist off'.

GB2272923 discloses and apparatus for circulating fluid. The device is used in the same types of wellbores including a production liner and production casing, whereby the device is engaged with a liner top and by applying weight a circulation port is opened to allow displacement of the production casing. There are two types of tools disclosed which perform the same function. The limitation of these tools are that there is no way to rotate or reciprocate the string when the circulation ports are opened. Furthermore there is also the risk of 'twist-off' of the 2⅞" drill pipe as disclosed previously.

U.S. Pat. No. 6,497,295 discloses a torque limiting tool which features a shear-able member which when an excess torque is detected it prevents a 'twist-off' by shearing the same member and sending a pressure signal to surface. This device can be used with U.S. Pat. No. 6,279,657 to overcome the issue of 'twist-off' except that the tool is not readily resettable. After removing a drill string from the production liner and due to the narrow clearance between the drill string and the liner, it is possible for debris or junk to become wedged between the two and the string becomes stuck. If this occurs it is highly desirable to be able to rotate the pipe to attempt to dislodge it. In this case if '295 shear-able member has been sheared, it will not be possible to rotate the string free resulting in an expensive fishing operation.

It is therefore desirable to use a device or system which allows unrestricted rotation and reciprocation while selectively opening and closing a circulation device to allow the production liner and production casing to the cleaned without compromising either three of these actions.

BRIEF SUMMARY

The apparatus of the present invention solves the problems confronted in the art in a simple and straightforward manner. The present invention provides a relockable shearing swivel tool which prevents accidental twist-off of a drill string, and which can be relocked by dropping an activation ball.

The present invention provides an oil well relockable shearing swivel downhole tool apparatus that includes an elongated tool body having upper and lower end portions, an upper section and a lower section.

An upper connection enables connection to an upper drill string section.

A lower connection enables connection to a lower drill string section.

An axial bore enables fluid communication between the upper and lower end portions.

The lower end portion of the tool body provides a ball seat and a ball retainer below the ball seat, inside the lower sub.

A first member is placed below the upper connection, with first interlocking portions on the first member.

A second member is placed in between the first member and the lower connection, and second interlocking portions on a second member.

A plurality of shear pins are placed on the tool body, the first and second interlocking portions being spaced apart a first distance in an initial position wherein relative rotation of the upper section relative to the lower section is prevented by the said shear pins.

A ball is sized and shaped to flow from the upper connection to the ball seat.

A drive nut is located above the ball seat.

A spring is placed in the tool body below the drive nut.

Wherein the ball is movable with the ball seat and the drive nut responsive to increased pressure in the bore above the ball to define a spring compressed position wherein the spring is compressed.

Wherein the ball is movable from the ball seat downwardly into the ball retainer responsive to increased pressure in the bore above the ball wherein the spring is released to lift the drive nut and the second member and wherein the first and second interlocking portions engage and interlock.

In one embodiment, the ball retainer has one or more bypass ports.

In one embodiment, the tool body includes a knocker sub below the upper connection.

In one embodiment, the shear pins form a connection between the knocker sub and the upper end portion of the tool body.

In one embodiment, the tool body carries a pump.

In one embodiment, the tool body includes an upper sub, a knocker sub and a lower sub.

In one embodiment, a threaded connection joins the upper sub to the knocker sub.

In one embodiment, a connection joins the knocker sub to the lower sub.

In one embodiment, the balls seat is in the lower sub.

In one embodiment, the drive nut is in the lower sub.

In one embodiment, the upper sub has a lower end and the lower sub extends upwardly above the lower end of the upper sub.

In one embodiment, the knocker sub has a lower end and the lower sub extends upwardly above the lower end of the knocker sub.

In one embodiment, the lower sub has intake ports that enable fluid intake to the pump at a position that is above the lower end of the upper sub.

In one embodiment, the spring is in the lower sub.

In one embodiment, the shear pins connect the upper sub to the knocker sub at a position above the lower sub.

The present invention can include a lockable weight set circulation tool that can be run in tandem with the relockable shearing swivel tool (see FIG. 5).

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
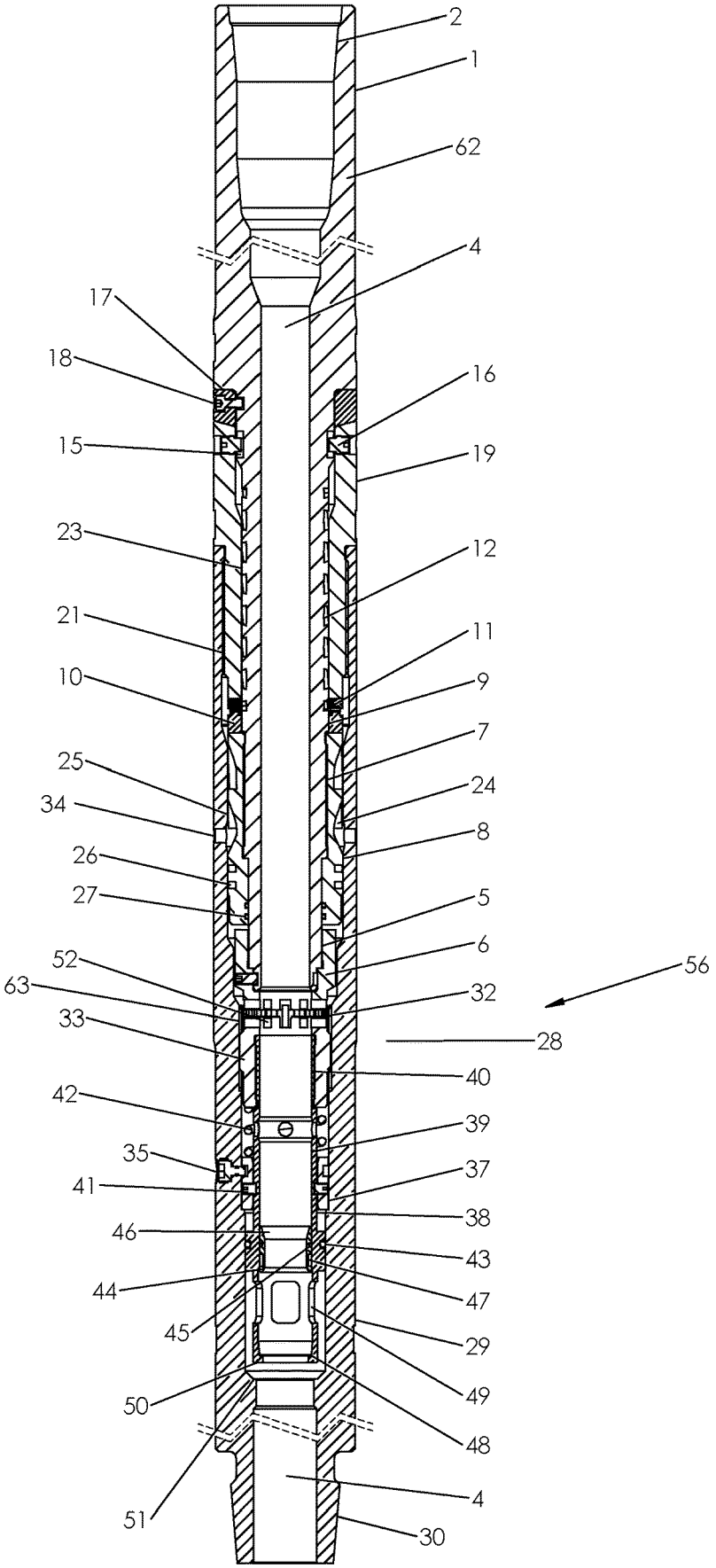
FIG. 1 shows the tool in an initial position where the upper drill string and the lower drill string are locked rotationally by torque shear pins.

FIGS. 1-5 show the preferred embodiment of the apparatus of the present invention designated generally by the numeral 56. Relockable shearing swivel tool apparatus 56 provides an elongated tool body 62 that includes connectable sections, namely top sub 1, knocker sub 19, and bottom sub 29. The tool body 62 has upper connection 2 enabling connection to upper drill string 3 (see FIG. 5). In the exemplary installation 65 of FIG. 5 can be seen placement of production casing 54, upper annulus 60, lower annulus 61, lower drill string 31, production liner 55 and liner hanger 59. Above liner hanger 59 is landing sub 58. Above landing sub 58 is lockable weight set circulation tool 100. Above lockable weight set circulation tool 100 is relockable shearing swivel tool 56. Axial bore 4 enables fluid flow through upper drilling string 3, tool 56, tool 100, landing sub 58, and lower drill string 31.

Figure 2:
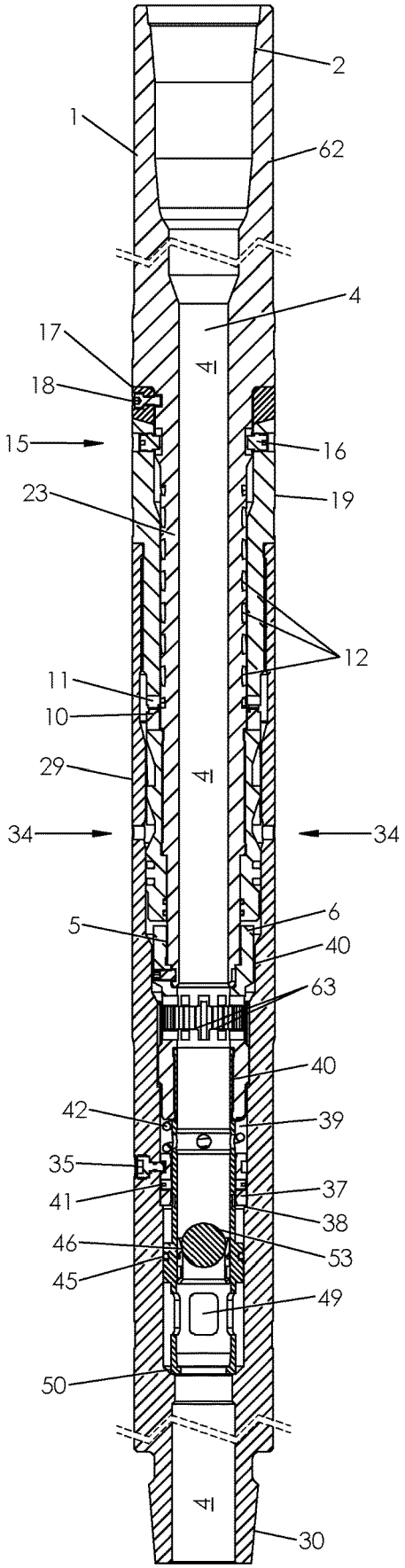
FIG. 2 shows the tool in a second sequential "cocked" position where the torque shear pins have been ruptured resulting in the upper drill string and lower drill string being able to rotate independently, and where a ball has been pumped down and has landed on a ball seat which has moved the spring housing and associated components downwards compressing the spring.

FIGS. 1-4 show relockable shearing swivel tool 56 in more detail. The tool 56 has axial bore 4 that is open ended, extending from upper connection 2 to lower connection 30. FIG. 1 shows the tool 56 in an initial position where upper drill string 3 and lower drill string 31 are locked rotationally by torque shear pins 16. By creating differential torque in upper and lower drill strings 3, 31 the torque shear pins 16 are sheared so that the upper and lower drill strings 3, 31 are able to rotate independently (see FIG. 2). In FIG. 2, ball 53 has been pumped downwardly via axial bore 4 and landed upon ball seat 46. Increasing pump pressure forces ball 53 and spring housing 39 downwardly compressing spring 42 (see FIG. 2). In this position, ball 53 rests upon seat 46. Ball retainer 44 is held by a series of shear screws 47.

Additional pump pressure is applied to force ball 53 down, past ball seat 53 and into ball retainer 44. Ball retainer 44 is located in bottom sub 29. Ball retainer 44 has lower face 50, O-rings 45 and internal abutment 48. When ball retainer 44 travels down responsive to pump pressure, it has face 50 that rests upon internal abutment 51 of bottom sub 29. Ball retainer 44 has bypass ports 49.

Figure 3:
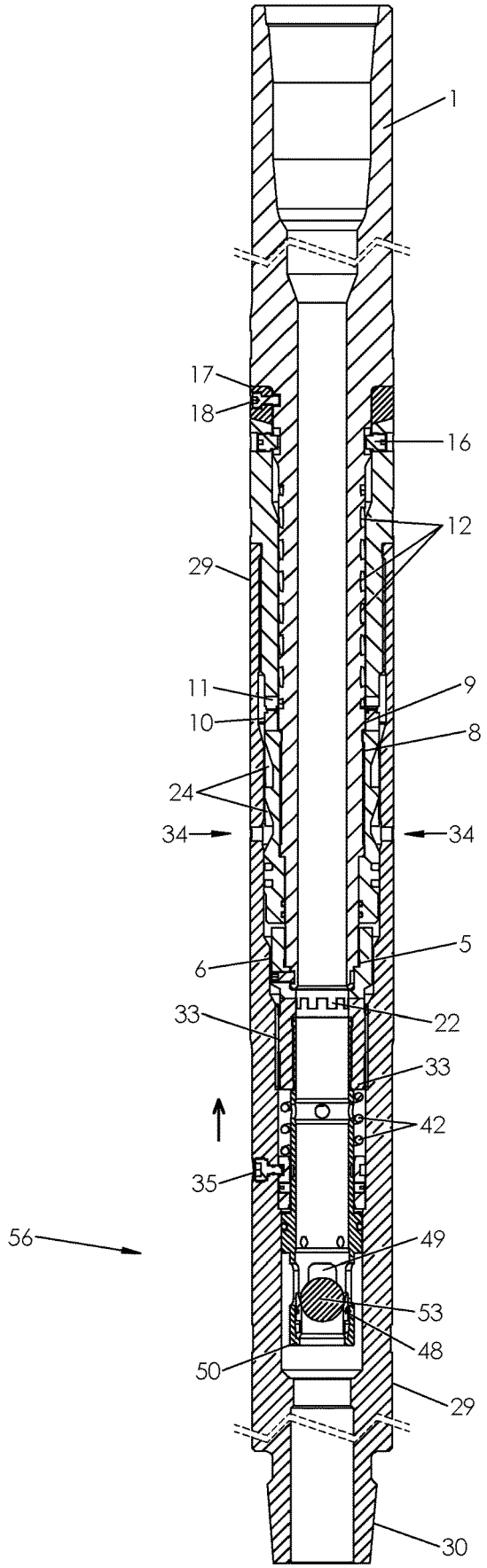
FIG. 3 shows the tool in a third sequential and relocked position where the ball retainer has traveled to a downwards position, and the spring housing and associated components have been moved in an upwards position by the spring which results in the interlocking portions or castellations of the upper drive nut and lower drive nut engaging the conspiring to lock the upper drill string and the lower drill string rotationally.

Once ball 53 is pumped below seat 46 and into ball retainer 44, spring 42 forces spring housing up to the position seen in FIG. 3. Spring housing 39 and associated components are moved up by spring 42 which results in the interlocking portion or castellations 52 of upper drive nut 6 engaging the interlocking portion or castellations 63 of lower drive nut 33 (see FIG. 3). The castellations 52, 63 are locked together in FIG. 3. Once so locked together, the upper drill string 3 can be rotated or reciprocated with lower drill string 31 as necessarily occurs during well cleaning.

Figure 4:
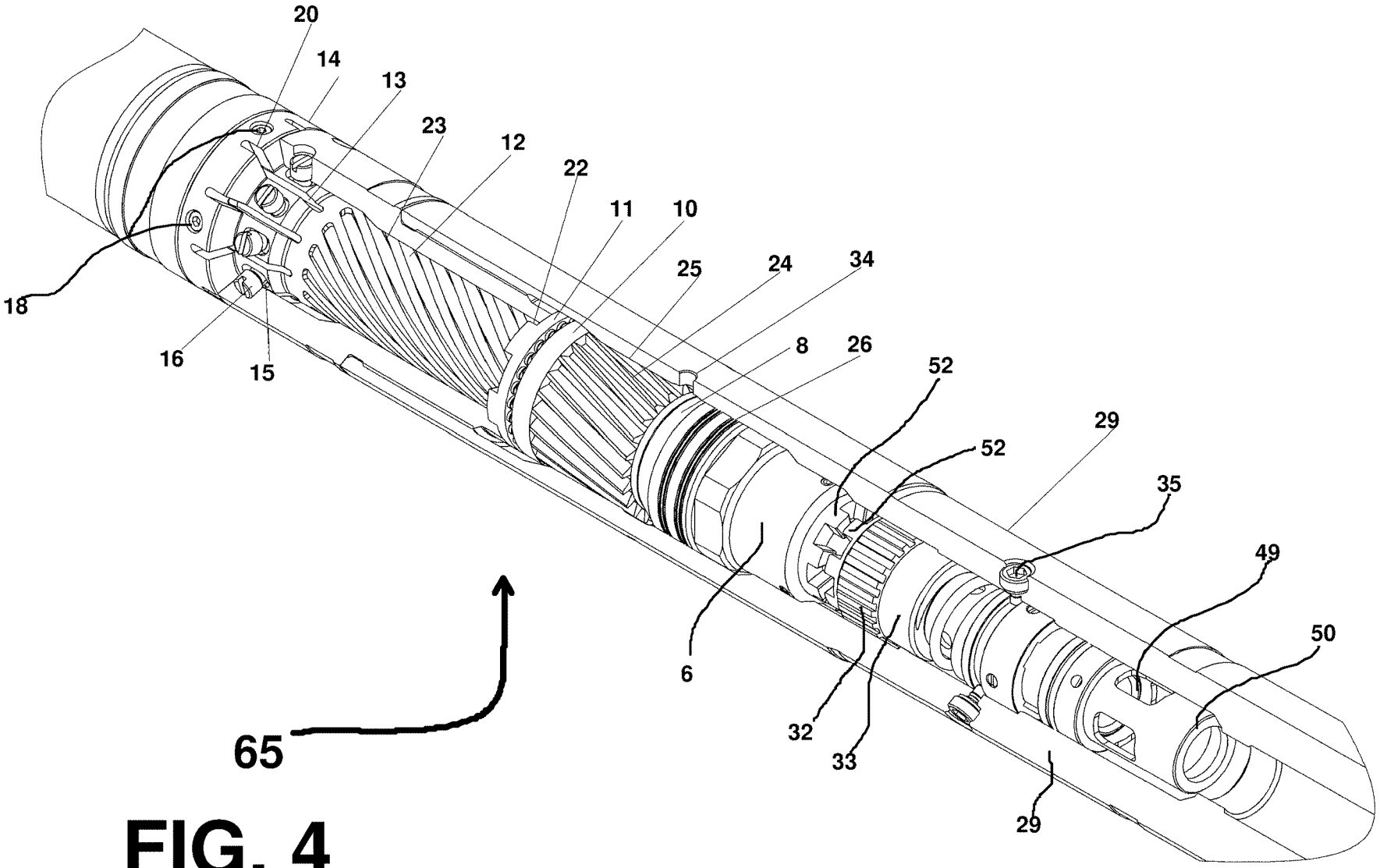
FIG. 4 shows the tool as illustrated in FIG. 1 in a perspective or isometric cutaway view to illustrate the components of the screw pumping mechanism.

FIG. 4 shows in perspective view the components of the screw pumping mechanism 65. Pumping mechanism 65 is used to remove heat from the tool body 62. Water courses 20 are placed in between torque shear pins 16. Holes 15 are provided to hold the pins 16. Water courses 20 communicate with bypass channels 13. Internal cylindrical portion 23 has helical grooves 12, castellations 22, and lower stator bearing 11.

The relockable shearing swivel tool 56 and its components will now be discussed in more detail. The top sub 1 is an elongated member with an upper connection 2 to allow it to be connected to upper drill string 3. Axial bore 4 allows pumping of cleaning fluids. Spline 5 is provided to rotationally lock it to an upper drill nut 6. Male thread 7 allows connection to impeller nut 8. A series of castellations 9 rotationally lock to a lower rotator bearing 10. A series of helical grooves 12 which when the top sub 1 rotates acts as a screw pump. A series of bypass channels 13 pump the fluid through an upper thrust bearing 14. A series of holes 15 house torque shear pins 16 where the bypass channels 13 run between the holes 15. A shoulder area 17 accommodates upper thrust bearing 14.

The upper trust bearing 14 is locked to top sub 1 by a series of bolts 18 and is placed between the top sub 1 and a knocker sub 19 so that when the top sub 1 and knocker sub 19 rotate relative to each other, the upper thrust bearing 14 wears sacrificially. There are water courses 20 cut in the load bearing face of upper thrust bearing 14 which allows a pumped fluid to pass which act to cool and lubricate the upper thrust bearing 14. The upper thrust bearing 14 can be made of a bronze alloy but could be of other construction such as ceramics, polycrystalline diamond, ball bearing or other.

The knocker sub 19 has a face at an upper end which contacts the upper thrust bearing 14. A male thread 21 at the opposite which engages to and rotationally locks with the bottom sub 29. A series of castellations 22 rotationally lock to lower stator bearing 11. Internal cylindrical portion 23 houses the aforementioned top sub 1 where the internal cylindrical portion 23 and helical grooves 24 form the housing and rotor of the screw pump. The series of torque shear pins 16 rotationally lock the knocker sub 19 and top sub 1 such that when the top sub 1 is rotated by the upper drill string 3, torque is transmitted through it through the torque shear pins 16, through the knocker sub 19, through the bottom sub 29 and the lower drill string 31. The lower stator bearing 11 and lower rotor bearing 10 can be made of PCD polycrystalline diamond, but could be of other construction such as bronze alloy, ceramics, polycrystalline diamond, ball bearings or other.

Impeller nut 8 features an internal thread which locks it rotationally to the top sub 1 as well as carrying the tensile load of the tool body. Impeller nut 8 features a series of helical grooves 24 cut on the external surface which when placed inside an internal bore 25 of the bottom sub 29 forms rotor and housing of a screw pump. Rotary seals 26 form a hydraulic seal with the aforementioned internal bore 25. Two internal O-rings 27 form a hydraulic seal with the top sub 1. The two seals 26 combine to form an hydrostatic barrier between the axial bore 4 and annulus 28, thus ensuring cleaning chemicals and fluids can be pumped through the tool 56. Bottom sub 29 is an elongated member with lower connection 30 to allow it to be connected to lower drill string 31. Axial bore 4 allows pumping of cleaning fluids. Internal spline 32 engages lower drive nut 33. A series of intake ports 34 (e.g., formed by drilling a series of radial holes) immediately adjacent to the impeller nut 8, helical grooves 24 such that they allow annular fluid to enter the aforementioned screw pump mechanism. Radial threaded holes accommodate locking pins 35, an internal abutment 36 to locate stop ring 37; an internal abutment 38 to engage with spring housing 39.

Spring housing 39 is an elongated member which resides in the bottom sub 29 and forms the main structure in a sub-assembly which acts as the relocking element of the invention. Spring housing 39 features a threaded portion 40 at an upper end which engages with the lower drive nut 33. Holes which accommodate shear screws 41 temporarily lock to the aforementioned stop ring 37. A shaft accommodates spring 42 which is mounted about the shaft and compressed between the lower drive nut 33 and the stop ring 37.

During use, the tool body 62 is connected in the drill string between the upper drill string 3 and lower drill string 31. The upper drill string 3 is rotated which transmits torque and rotation through the tool body 62 to the lower drill string 31. The drill string can be rotated and reciprocated, allowing the well to be cleaned. It is also possible to function circulation tools to assist in the cleaning. If a predetermined torque limit is exceeded, the torque shearing pins 16 shear and the tool 56 becomes a swivel to allow the upper drill string 3 to rotate independently from the lower drill string 31, thus preventing an accidental twist-off of the lower drill string 31. Depending if the tool 56 is in compression or tension, the load axial load of the string will be borne by the upper thrust bearing 14 [compression] or the lower rotor/lower stator bearing 10 [tension] respectively. The rotation of the parts generates heat. The lower bearing 10 is cooled by circulating wellbore fluid through screw type fluid pump 65. When the upper 3 and lower components 31 of the tool 56 rotate with respect to each other, fluid is drawn from the annulus 28 through the entry ports and along the helical grooves 12 in the impeller nut 8 in an upwards direction. The fluid then flows between the lower stator bearing 11 and the lower rotor bearing 10 to cool it. Fluid is then drawn by the helical grooves cut in the top sub 1 and is diverted through the bypass channels 13 and through the water courses 20 which keep up the upper bearing 14 cool and lubricated.

When it is desired to relock the swivel to allow rotation to be applied between the top sub 1 and bottom sub 29, a ball 53 (or dart or other suitable or like object) can be pumped down to land on a ball seat 46 on the ball retainer 44. As pressure is applied, the shear screw 47 located between the spring housing 39 and stop ring 37 shear and spring housing 39 moves downwards compressing the spring 42. The spring housing 39 will then abut against the bottom sub 29 and as pressure increases the shear screws 47 related to the ball retainer 44 will shear, which releases the downward force and causes the spring 42 to move the spring housing 39 upwards. As this happens, the catellations 52, 53 between the upper drive nut 6 and lower drive nut 33 engage. Torque can now be applied between the upper 3 and lower drill strings 31 by the connection of the top sub 1, upper drive nut 6, lower drive nut 33 and bottom sub 29.

Figure 5:
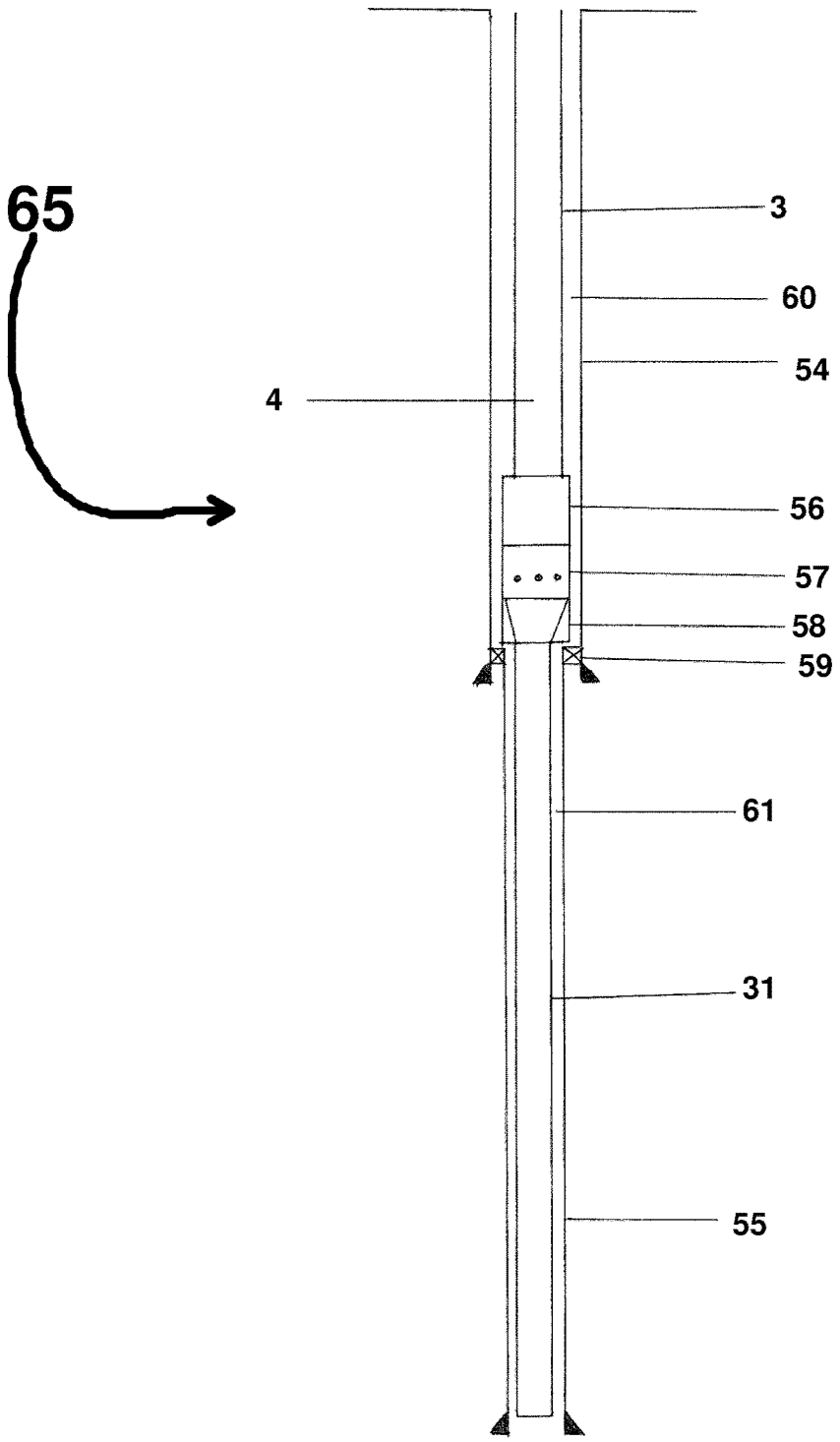
FIG. 5 shows an exemplary application of the tool in an oil well and connected between an upper drill string and lower drill string and connected to a circulation tool and a landing sub where the tool is located above a liner hanger.

Lockable weight set circulation tool 100 of FIGS. 6-12 can be run in tandem with the relockable shearing swivel tool 56 (as seen in FIG. 5) to allow selective opening and closing of radial circulation ports to allow circulation of the upper annulus 60 and lower annulus 61 independently. The apparatus 100 is functioned by the application of string weight, typically by using landing sub 58 which can engage liner hanger 59 (see FIG. 5) and by the application of weight can cycle the tool 100 through various operating positions. Whereas there are devices which require the continued application of weight to keep the circulation ports opened, the apparatus 100 device is activated by the application of weight and can have the circulation ports locked or closed as desired by the operator and without the continued application of weight.

The apparatus 100 disclosed uses a guide pin which locates in a continuous indexing slot milled onto an indexing sleeve, where each application and subsequent removal of weight to the tool shall cycle the tool the next indexing position. The device follows an infinite repeating cycle of CLOSED>OPEN>CLOSED>CLOSED>OPEN>CLOSED>CLOSED>OPEN, but can be reconfigured to follow other combinations such as CLOSED>OPEN>CLOSED>OPEN.

In FIGS. 6-12, apparatus 100 has a tool body that includes top sub 101, spline mandrel 106, drive mandrel 108, and knocker sub 110. The top sub 101 is an elongated member with an upper connection 102 to allow it to be connected to an upper drill string 3, an axial bore 104 to allow pumping of cleaning fluids and a threaded connection 105 to allow connection to spline mandrel 106.

Spline mandrel 106 is an elongated member with threaded connection 105 to connect to the top sub 101, axial bore 104 to allow pumping of cleaning fluids, a spline 107 to rotationally lock it to drive mandrel 108 and allow the drive mandrel 108 and spline mandrel 106 to slide telescopically.

Shoulder 109 abuts against shoulder 145 of spline mandrel 106 which can hold the full weight of the drill string 3, 31 when required. A series of radial internal circulation ports 111 allow a flow path between the axial bore 104 and the annulus 112 when desired, which is straddled by seal 113. Index sleeve 114 is located at the lower end of male thread 115 which can accommodate a plug 116.

Drive mandrel 108 is an elongated member with a lower connection 117 to allow it to be connected lower drill string 31, axial bore 104 allows pumping of cleaning fluids. Threaded connection 119 at the upper end of drive mandrel 108 connects to the knocker sub 110. Internal spline portion of drive mandrel 108 engages with the spline 107 of spline mandrel 106. A series of holes accommodate shear pins 120 which mate with the drive mandrel 108. A series of radial external circulation ports 121 are provided to selectively circulate fluid from the axial bore 104 to the annulus 112. A hole is in drive mandrel 108 is provided to accommodate a guide pin 122. An internal seal bore 123 accommodates seals. A separate seal bore 124 accommodates plug 140.

Figure 6:
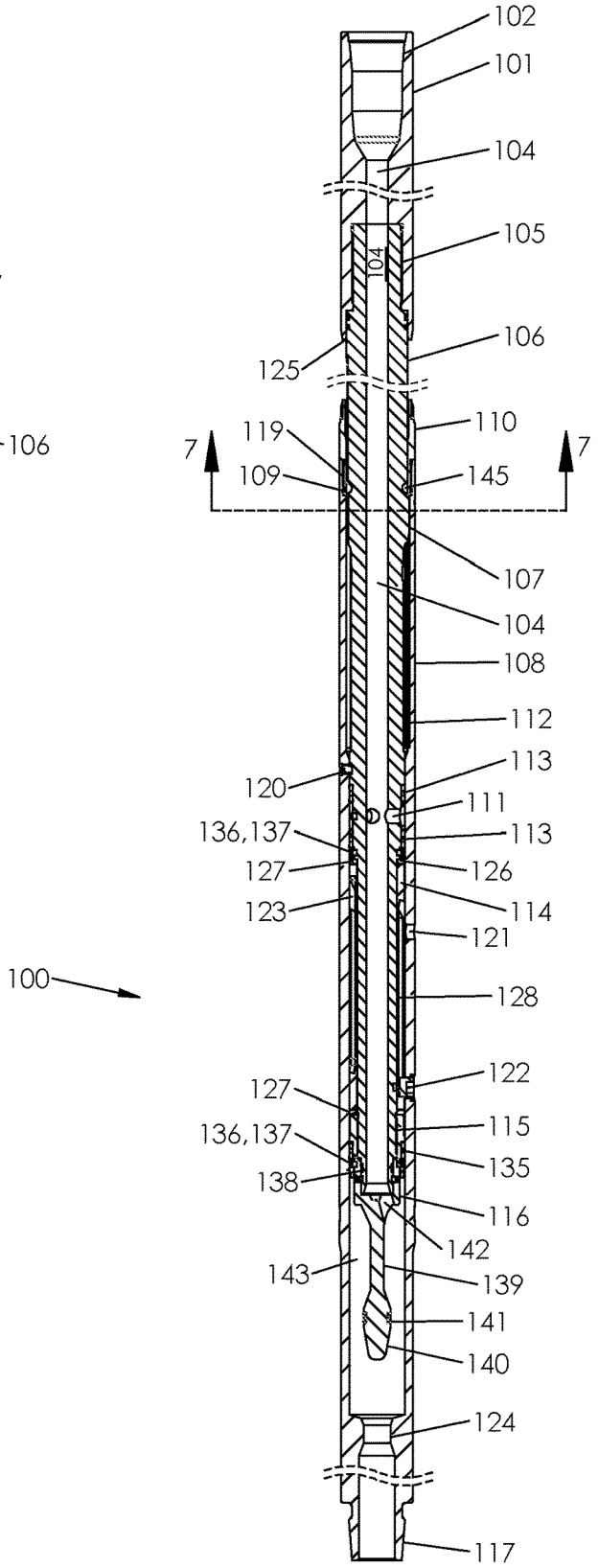
FIG. 6 is a sectional elevation view showing the lockable weight set circulation tool that can be used in tandem with the swivel tool of FIGS. 1-4.
Figure 8:
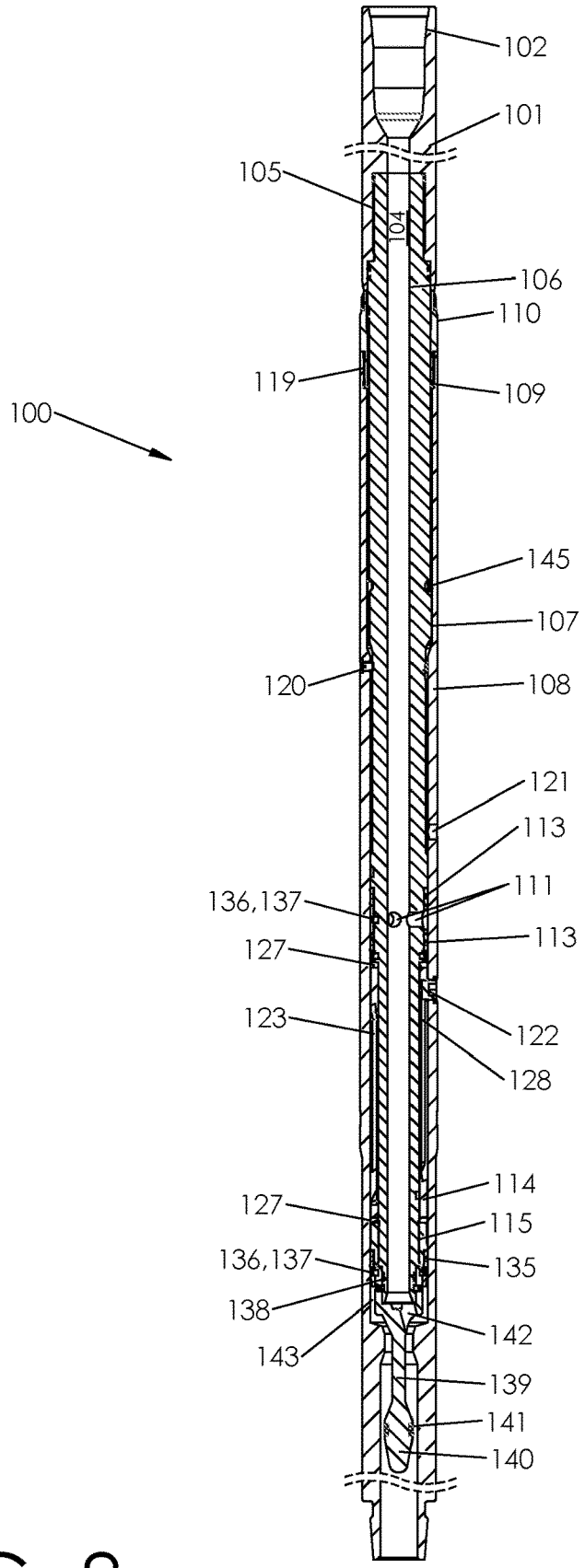
FIG. 8 is a sectional elevation view showing the lockable weight set circulation tool that can be used in tandem with the swivel tool of FIGS. 1-4.

Knocker sub 110 is fixed to the drive mandrel 108 by way of threaded connection. Knocker sub 110 is mounted onto the drive mandrel 108 and is used to restrict the slide-able movement of the spline mandrel 106 by shoulder 125 of top sub abutting against a shoulder of knocker sub 110. FIG. 6 shows a non-abutting condition, and FIG. 8 shows an abutting condition.

Index sleeve 114 (FIG. 11) is mounted on the drive sleeve/spline mandrel 106 at the lower end of spline mandrel 106, and located between a shoulder and the plug 116, such that index sleeve 114 cannot slide relative to the drive sleeve/spline mandrel 106, but also features two bearings 127 which allow index sleeve 114 to rotate. The index sleeve 114 also features a continuous indexing slot 128 which accommodates guide pin 122 such that indexing slot 128 follows a cyclical pattern through a series of functional positions. Indexing slot 128 dictates the axial position of the drive mandrel 108 and spline mandrel 106 in relation to each other, and hence the alignment of the external circulation ports 121 and internal circulation ports 111 in relation to each other. These positions are defined (see FIG. 12) as the "open" 129, "closed" 130, "cocked long" 131 and "cocked short" 132. A set of seals 135 are mounted either side of the internal circulation ports 111 on the drive sleeve and seal on the internal bore 123. A further seal can be located on the plug 116 which forms an hydraulic seal around the guide pin 122 preventing leakage past it. Each seal 135 is restrained by a lock ring 136 and screws 137. When in the open position, the external 121 and internal 111 circulation ports align to allow a flow path from the axial bore 104 to the annulus 112. In the "closed" 130, "cocked long" 131 and "cocked short" 132 positions, the internal seal bore 123 seals against the seals 113 and closes the flow path.

The plug 116,140 is connected to the lower end of the spline mandrel 106. It houses one of the aforementioned seals 135 which conspire with an O-ring 138 to form an hydraulic barrier. The plug 116 has an elongated end 139 with a bulbous feature 140 housing further O-rings 141 as well as a series of bypass ports 142, such that when the apparatus 100 is in the open 129 position, the O-rings 141 are stung into a seal bore on the drive mandrel 108 which seals the axial bore 104 preventing fluid from passing in either direction, and because the circulation ports are also in the open position, fluid pumped from the surface will exit the circulation ports and none can pass to the lower drill string 31. Furthermore, when the apparatus 100 is in any of the other positions, the bulbous feature 140 will not engage the seal bore 124 and fluid can be pumped through the axial bore 104, through the bypass ports 142, and through an annulus 143 created between the seal bore 124 and the elongated end 139.

In the initial "closed" 130 position, the tool has shear pins 120 intact which prevents axial compressive load causing the tool 100 to stroke, provided the axial load does not exceed the maximum shear strength of the shear pins 120. The selection of the shear pins 120 is important as this determines how the tool 100 may interact with other tools in the drill string. It also allows limited weight to be applied to the lower drill string 31 in the event it is required to drill cement or other debris in the wellbore without accidentally functioning the tool 100. In this position it is possible to pump cleaning chemicals and fluids downwards through the upper drills string 3 and lower drill string 31 to clean the production liner 55.

When it is desired to open the circulation port, a compressive load is applied to the tool 100. This is done by lowering the drills string 3, 31 until a landing sub 58 which is connected below the tool 100 lands onto a shoulder in the wellbore such as a liner top. As weight is continued to be applied, the shear pins 120 will rupture and the tool 100 will stroke moving the guide pin 122 along the indexing slot 128 until it reaches the cocked long 131 position.

The operator then raises the drill string 3, 31 until a tensile load strokes the tool 100 open and the guide pin 122 travels to the "open" 129 position aligning the internal circulation ports 111 and external circulation ports 121. The operator can then pump chemicals down the upper drill string 3 into the annulus 112 to clean the production casing 54.

The operator can then repeat the action of applying weight by lowering the drill string 3, 31 until the landing sub 58 engages the liner top to cycle the tool to the "closed" 130 position to allow further circulation of fluids through the production liner 55.

The device 100 can be cycled infinitely by the operator following repeating cycles of CLOSED>OPEN>CLOSED>CLOSED>OPEN>CLOSED>CLOSED>OPEN. The index slot 128 could be reconfigured to follow other combinations such as CLOSED>OPEN>CLOSED>OPEN.

Figure 7:
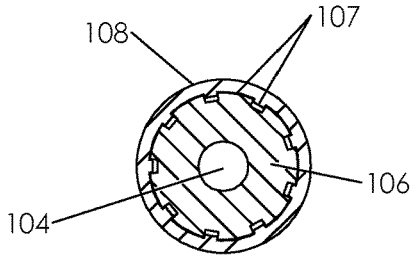
FIG. 7 is a sectional view taken along lines A-A of FIG. 6.

FIG. 6 shows the tool in an initial closed position where the shear pins 120 are intact. The guide pin 122 is located in the CLOSED position of the indexing slot 128. The shoulder 109 of the knocker sub 110 is engaged to the shoulder 145 of the spline mandrel 106 and the internal circulation ports 111 and external circulation ports 121 are misaligned from the axial bore 104 to the annulus, and the plug 140 is not stung into the seal bore 124 allowing fluid to be pumped through the axial bore 104 without restriction. FIG. 7 is a sectional view of the tool taken from the lines A-A in FIG. 6.

FIG. 8 shows the tool in a cocked long position where axial force has been applied through the upper connection 102 and lower connection 117 which has sheared the shear pin 120 resulting in the tool stroking. The spline 107 between the spline mandrel 106 and drive mandrel 108 guides the two components 106,108 as they stroke relative to each other. Simultaneously, the guide pin 122 travels through the index slot 128 in the direction illustrated by the arrow shown in FIG. 12, then following the index slot 128 at an angle until guide pin 122 comes to rest at the cocked long position. In this position [cocked long position] the top sub 101 and knocker sub 110 have abutted against each other restricting any further stroking of the tool. Furthermore, the internal circulation ports 111 and external circulation ports 121 are misaligned preventing any circulation from the axial bore 104 to the annulus, and the plug 140 is not stung into the seal bore 124 allowing fluid to be pumped through the axial bore 104 without restriction.

Figure 9:
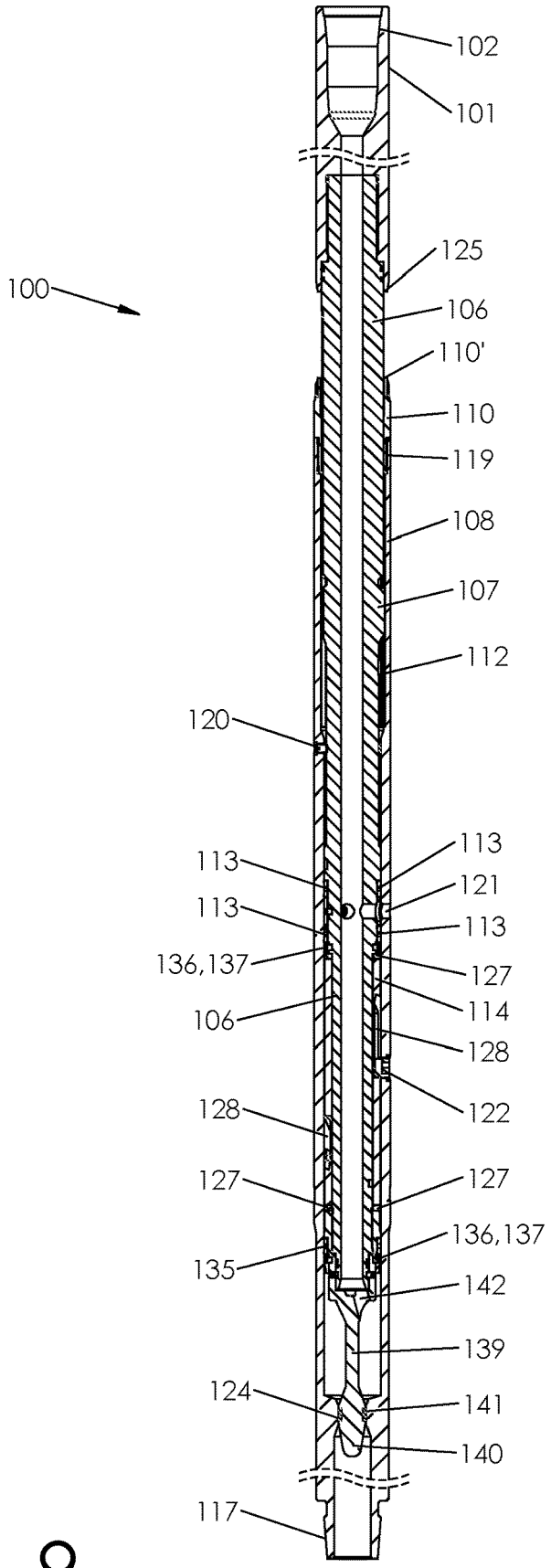
FIG. 9 is a sectional elevation view showing the lockable weight set circulation tool that can be used in tandem with the swivel tool of FIGS. 1-4.
Figure 12:
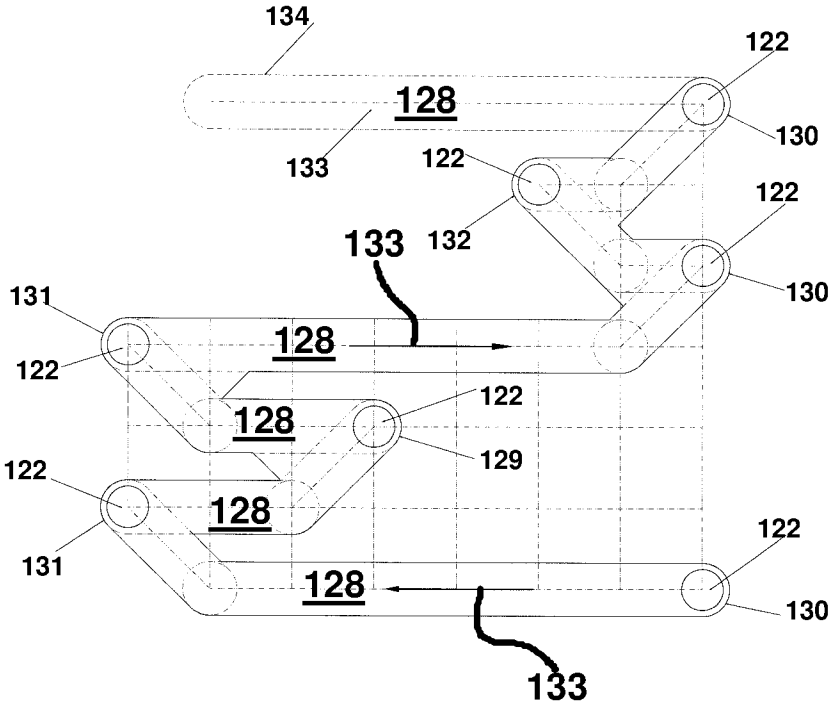
FIG. 12 is a schematic diagram showing an expanded view of the index slot.

FIG. 9 shows the tool in an open position where tensional force has been applied through the upper connection 102 and the lower connection 117 causing the tool to stroke apart, where the guide pin 122 moves along the index slot 128 in first a straight and then angular path until it comes to rest in the open position (see FIG. 12). In this position [open] the internal circulation ports 111 and external circulation ports 121 are aligned allowing a free circulation path from the axial bore 104 to the annulus 112, and the plug 140 is stung into the seal bore 124 preventing fluid to be pumped to the lower drill string.

Figure 10:
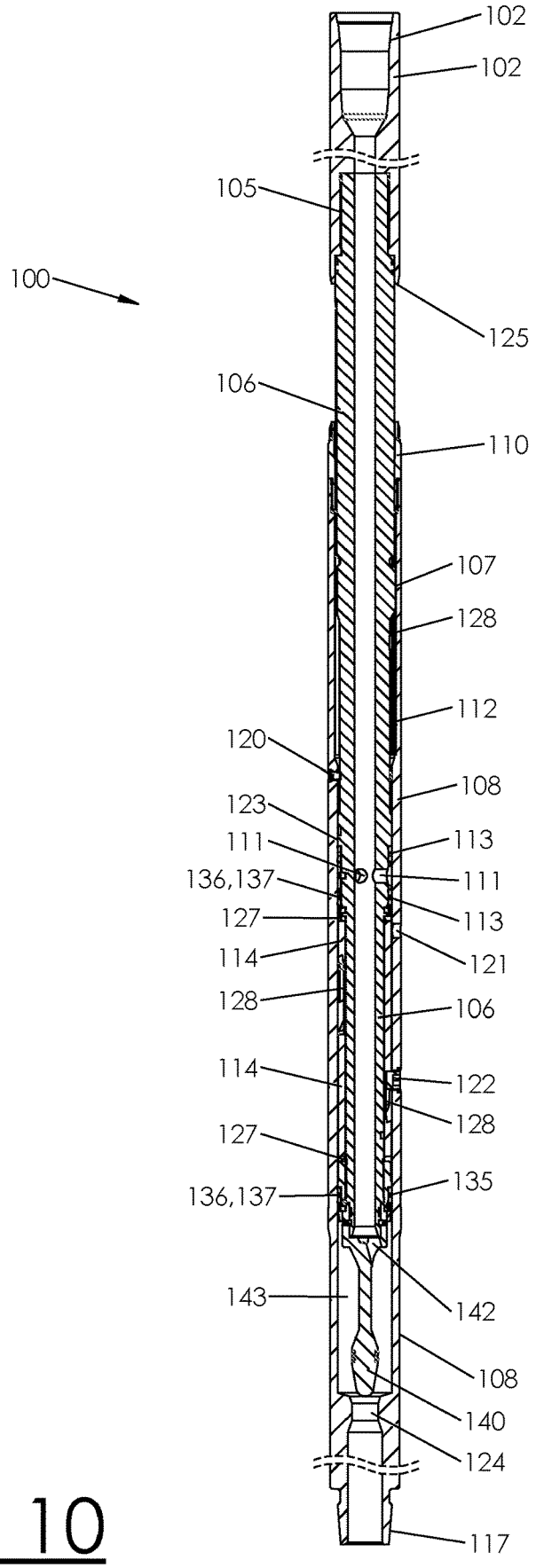
FIG. 10 is a sectional elevation view showing the lockable weight set circulation tool that can be used in tandem with the swivel tool of FIGS. 1-4.

FIG. 10 shows the tool in the cocked short position where axial force has been applied through the tool moving the guide pin 122 in the direction illustrated by the arrow (see FIG. 12), then following the index slot 128 at an angle until it comes to rest at the cocked short position; the internal circulation ports 111 and external circulation ports 121 are misaligned preventing any circulation from the axial bore 104 to the annulus 112, and the plug 140 is not stung into the seal bore 140 allowing fluid to be pumped through the axial bore 104 without restriction.

Figure 11:
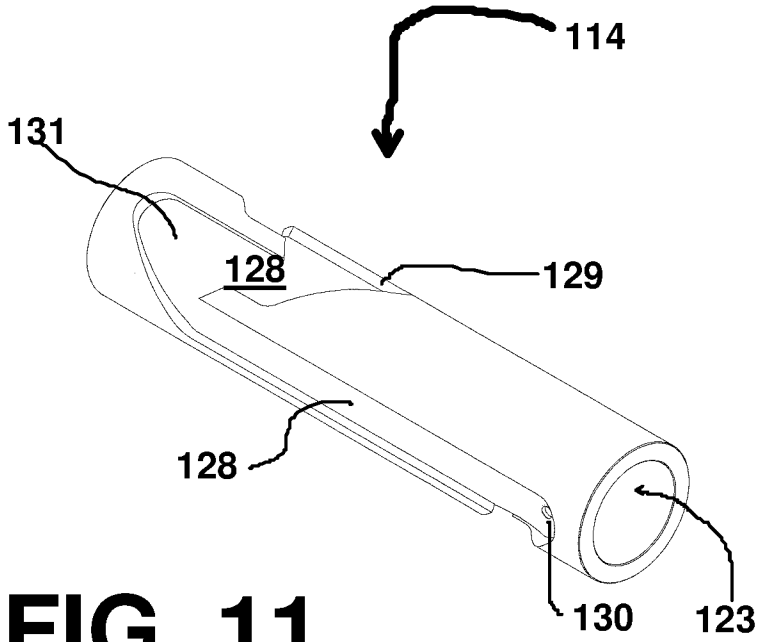
FIG. 11 is a fragmentary perspective view of the preferred embodiment of the apparatus of the present invention.

FIG. 11 shows an external view of the index sleeve 114 with the index slot 128 cut in a continuous path around the external surface. FIG. 12 shows an expanded view of the index slot 128 as if unwrapped from the circumference of the index sleeve 114 and laid flat. It shows the guide pins 122 in the various positions OPEN (129), CLOSED (130), COCKED LONG (131) and COCKED SHORT (131).

The following is a list of parts and materials suitable for use in the present invention:

PARTS LIST:

| PART NUMBER | DESCRIPTION |
|---|---|
| 1 | top sub |
| 2 | upper connection |
| 3 | upper drill string |
| 4 | axial bore |
| 5 | spline |
| 6 | upper driver nut |
| 7 | male thread |
| 8 | impeller nut |
| 9 | castellations |

-continued

PARTS LIST:

| PART NUMBER | DESCRIPTION |
|---|---|
| 10 | lower rotor bearing |
| 11 | lower stator bearing |
| 12 | helical grooves |
| 13 | bypass channels |
| 14 | upper thrust bearing |
| 15 | holes |
| 16 | torque shear pins |
| 17 | shoulder area |
| 18 | bolts |
| 19 | knocker sub |
| 20 | water courses |
| 21 | male thread |
| 22 | castellations |
| 23 | internal cylindrical portion |
| 24 | helical grooves |
| 25 | internal bore of the bottom sub |
| 26 | rotary seals |
| 27 | O-rings |
| 28 | annulus |
| 29 | bottom sub |
| 30 | lower connection |
| 31 | lower drilling string |
| 32 | internal spline |
| 33 | lower drive nut |
| 34 | intake ports |
| 35 | locking pins |
| 36 | internal abutment |
| 37 | stop ring |
| 38 | internal abutment |
| 39 | spring housing |
| 40 | threaded portion |
| 41 | shear screws |
| 42 | spring |
| 43 | O-ring |
| 44 | ball retainer |
| 45 | O-ring |
| 46 | ball seat |
| 47 | shear screws |
| 48 | internal abutment |
| 49 | bypass ports |
| 50 | lower face |
| 51 | internal abutment |
| 52 | castellations |
| 53 | ball |
| 54 | production casing |
| 55 | production liner |
| 56 | relockable shearing swivel tool |
| 58 | landing sub |
| 59 | liner hanger |
| 60 | upper annulus |
| 61 | lower annulus |
| 62 | tool body |
| 63 | castellations |
| 64 | installation |
| 65 | pumping mechanism/screw type fluid pump |
| 100 | tool/lockable weight set circulation tool/apparatus |
| 101 | top sub |
| 102 | upper connection |
| 103 | tool body |
| 104 | axial bore |
| 105 | threaded connection |
| 106 | spline mandrel |
| 107 | spline |
| 108 | drive mandrel |
| 109 | shoulder |
| 110 | knocker sub |
| 111 | internal circulation ports |
| 112 | annulus |
| 113 | seals |
| 114 | index sleeve |
| 115 | male thread |
| 116 | plug |
| 117 | lower connection |

-continued

PARTS LIST:

| PART NUMBER | DESCRIPTION |
|---|---|
| 118 | internal spline portion |
| 119 | threaded connection |
| 120 | shear pins |
| 121 | external circulation ports |
| 122 | guide pin |
| 123 | internal seal bore |
| 124 | seal bore |
| 125 | shoulder |
| 126 | shoulder |
| 127 | bearings |
| 128 | indexing slot |
| 129 | open |
| 130 | closed |
| 131 | cocked long |
| 132 | cocked short |
| 133 | arrow |
| 134 | repeated feature |
| 135 | seal |
| 136 | lock ring |
| 137 | screws |
| 138 | O-ring |
| 139 | elongated end |
| 140 | bulbous feature |
| 141 | O-rings |
| 142 | bypass ports |
| 143 | annulus |
| 145 | annulus |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An oil well relockable shearing swivel downhole tool apparatus, comprising:

a) an elongated tool body having upper and lower end portions, an upper section and a lower section;

b) an upper connection that enables connection to an upper drill string section;

c) a lower connection that enables connection to a lower drill string section;

d) an axial bore that communicates between the upper and lower end portions;

e) the lower end portion housing a ball seat and a ball retainer below the ball seat;

f) a first member below the upper connection, a first interlocking portion on the first member;

g) a second member in between the first member and the lower connection, a second interlocking portion on a second member;

h) at least one shear pin on the tool body, the first and second interlocking portions being spaced apart a first distance in an initial position wherein relative rotation of the upper section relative to the lower section is prevented by the at least one shear pin and wherein differential torque between upper and lower sections enables shearing of the at least one shear pin and rotation of the upper and lower sections relative to one another;

i) a ball or plug that is sized and shaped to flow from the upper connection to the ball seat;

j) a drive nut above the ball seat;

k) a spring in the tool body below the drive nut;

l) wherein the ball is movable with the ball seat and the drive nut responsive to a first increased pressure valve in the bore above the ball to define a spring compressed position wherein the drive nut moves down and the spring is compressed;

m) wherein the ball is movable from the ball seat downwardly into the ball retainer responsive to increased second pressure valve in the bore above the ball wherein the spring is released to lift the drive nut and the second member and wherein the first and second interlocking portions engage and interlock so that the upper and lower sections can be rotated and reciprocated together.

2. The oil well relockable shearing swivel downhole tool apparatus of claim 1 wherein ball retainer has one or more bypass ports.

3. The oil well relockable shearing swivel downhole tool apparatus of claim 1, wherein the tool body includes a knocker sub below the upper connection.

4. The oil well relockable shearing swivel downhole tool apparatus of claim 3, wherein the shear pins form a connection between the knocker sub and the upper end portion of the tool body.

5. The oil well relockable shearing swivel downhole tool apparatus of claim 1, wherein the tool body carries a pump.

6. The oil well relockable shearing swivel downhole tool apparatus of claim 1, wherein the tool body includes an upper sub, a knocker sub and a lower sub.

7. The oil well relockable shearing swivel downhole tool apparatus of claim 1, wherein the balls seat is in the lower sub.

8. The oil well relockable shearing swivel downhole tool apparatus of claim 1, wherein the upper sub has a lower end and the lower sub extends upwardly above the lower end of the upper sub.

9. The oil well relockable shearing swivel downhole tool apparatus of claim 1, wherein the knocker sub has a lower end and the lower sub extends upwardly above the lower end of the knocker sub.

10. The oil well relockable shearing swivel downhole tool apparatus of claim 1, wherein the lower sub has intake ports that enable fluid intake to the pump at a position that is above the lower end of the upper sub.

11. The oil well relockable shearing swivel downhole tool apparatus of claim 1, wherein the shear pins connect the upper sub to the knocker sub at a position above the lower sub.

12. A method of locking a swivel tool, comprising the steps of:

a) connecting an elongated tool body to a drill string, the tool body having upper and lower end portions, an upper section, a lower section, a spring in the lower section and a drive nut above the spring and a ball retainer in the lower section;

b) wherein in step "a" the tool body has an upper connection that enables connection to an upper drill string section;

c) connecting the tool body to a drill string at the said upper connection;

d) wherein in step "a" the tool body has a lower connection that enables connection to a lower drill string section;

e) connecting the tool body to a drill string at the said lower connection;

f) wherein the tool body lower end portion houses a ball seat and a ball retainer below the ball seat;

g) the tool body providing a first member below the upper connection and first interlocking portions on the first member;

h) the tool body providing a second member in between the first member and the lower connection and second interlocking portions on the second member;

i) providing a plurality of shear pins on the tool body, the first and second interlocking portions being spaced apart a first distance in an initial position wherein relative rotation of the upper section relative to the lower section is prevented by the said shear pins;

j) shearing the pins by differential torque between the upper and lower sections;

k) transmitting a ball from the upper connection to the ball seat;

l) moving a ball responsive to increased pressure in the bore above the ball to define a spring compressed position wherein the spring is compressed;

m) moving the ball from the ball seat downwardly into the ball retainer responsive to increased pressure in the bore above the ball wherein the spring is released to lift the drive nut and the second member and wherein the first and second interlocking portions engage and interlock; and n) rotating and reciprocating the drill string and tool body after step "m".

* * * * *